US007746189B2

(12) United States Patent
Hocine et al.

(10) Patent No.: US 7,746,189 B2
(45) Date of Patent: Jun. 29, 2010

(54) WAVEGUIDE CIRCULATOR

(75) Inventors: Mahfoud Hocine, Brossard (CA); Marco Caplin, Kirkland (CA)

(73) Assignee: Apollo Microwaves, Ltd., Pointe Claire (CA)

( * ) Notice: Subject to any disclaimer, the term of this patent is extended or adjusted under 35 U.S.C. 154(b) by 90 days.

(21) Appl. No.: 12/212,723

(22) Filed: Sep. 18, 2008

(65) Prior Publication Data

US 2010/0066460 A1 Mar. 18, 2010

(51) Int. Cl.
*H01P 1/39* (2006.01)

(52) U.S. Cl. ..... 333/1.1; 333/24.2

(58) Field of Classification Search ..... 333/1.1, 333/24.2, 208, 209, 210
See application file for complete search history.

(56) References Cited

U.S. PATENT DOCUMENTS 3,466,571 A * 9/1969 Staggs et al. ..... 333/1.1
3,866,150 A 2/1975 Thai et al.
4,058,780 A 11/1977 Riblet
4,684,908 A 8/1987 Kuntzmann et al.
4,697,158 A 9/1987 Hoover et al.
5,576,670 A * 11/1996 Suzuki et al. ..... 333/126
6,359,792 B1 3/2002 Genfan
6,407,646 B1 6/2002 Johnson
6,518,851 B2 2/2003 Kocharyan
7,019,706 B2 3/2006 Yoneda et al.
7,176,767 B2 2/2007 Kroening
7,230,507 B2 6/2007 Kroening
7,242,263 B2 7/2007 Kroening
7,259,640 B2 8/2007 Brown et al.
7,332,982 B2 2/2008 Yun et al.
2005/0184833 A1 * 8/2005 Higgins et al. ..... 333/208
2006/0261909 A1 11/2006 Kroening

FOREIGN PATENT DOCUMENTS

JP 2007 005955 A 1/2007

OTHER PUBLICATIONS

"Design and fabrication of a nonradiative dielectric waveguide circulator," ieee.org Web page, Nov. 1998.
WR75 junction circulator using 90 degree and 180 degree ridge UEs, Helszajn, Tsounis & Caplin, IEE Proc.-Microw Antennas Propag. vol. 149, No. 2, Apr. 2002.

* cited by examiner

*Primary Examiner*—Stephen E Jones
(74) *Attorney, Agent, or Firm*—Seyfarth Shaw LLP

(57) ABSTRACT

A waveguide circulator comprising at least three waveguide arms intersecting at a junction, at least one ferrite element positioned within the junction, an impedance transformer and a recessed transformer. At least a portion of each of the at least three waveguide arms and the junction define a first wall and a second wall that are positioned in an opposing relationship. The impedance transformer is positioned in proximity to the at least one ferrite element and projects from the first wall. The recessed transformer is positioned in proximity to the impedance transformer and is recessed within the first wall.

16 Claims, 7 Drawing Sheets

WAVEGUIDE CIRCULATOR

FIELD OF THE INVENTION

The present invention relates to the field of passive microwave components, and specifically to a waveguide circulator that includes at least one recessed transformer for improving the bandwidth handling capabilities of the waveguide circulator.

BACKGROUND OF THE INVENTION

Waveguide circulators are known in the art for handling RF waves. Typically, waveguide circulators include three ports (although more or less ports are possible) and are used for transferring wave energy in a non-reciprocal manner, such that when wave energy is fed into one port, it is transferred to the next port only. A common use for waveguide circulators is to transmit energy from a transmitter to an antenna during transmitting operations, and to transmit energy from an antenna to a receiver during receiving operations.

In order to enable the non-reciprocal energy transfer, the waveguide circulators include ferrite resonators to which are applied a magnetic field via one or more magnets or electromagnets. In order to match the impedance of the ferrite gyrator (which includes the ferrite resonators and their mounting posts) to the input waveguides, a matching network is inserted between them. However, in practice, a conventional circulator with a ferrite gyrator coupled to a ¼ wavelength transformer produces a frequency response of about 21 dB return loss over a 26% frequency bandwidth. This is not the desired handling of the circulator.

In light of the above, there is a need in the industry for an improved waveguide circulator that alleviates, at least in part, the deficiencies with existing waveguide circulators.

SUMMARY OF THE INVENTION

In accordance with a first broad aspect, the present invention provides a circulator comprising at least three waveguide arms intersecting at a junction, at least one ferrite element positioned within the junction, an impedance transformer and a recessed transformer. At least a portion of each of the at least three waveguide arms and the junction define a first wall and a second wall that are positioned in an opposing relationship. The impedance transformer is positioned in proximity to the at least one ferrite element and projects from the first wall. The recessed transformer is positioned in proximity to the impedance transformer and is recessed within the first wall.

In accordance with a second broad aspect, the present invention provides a waveguide circulator comprising three waveguide arms each comprising a first wall and a second wall. The three waveguide arms intersect at a junction that includes at least one ferrite element therein. Each of the three waveguide arms further comprises an impedance transformer projecting from the first wall and a recessed transformer that is recessed within the second wall.

In accordance with a third broad aspect, the present invention provides a method. The method comprises providing a circulator with at least three waveguide arms intersecting at a junction and a pair of ferrite elements positioned in a spaced-apart opposing relationship within the junction. Each of the at least three waveguide arms and the junction define a first wall and a second wall that are positioned in an opposing relationship. The method further comprises providing at least one impedance transformer within the circulator in proximity to at least one of the pair of ferrite elements. The impedance transformer projects from the first wall. The method further comprises providing at least one recessed transformer in proximity to the at least one impedance transformer. The recessed transformer is recessed within the first wall of the circulator.

Figure 1:
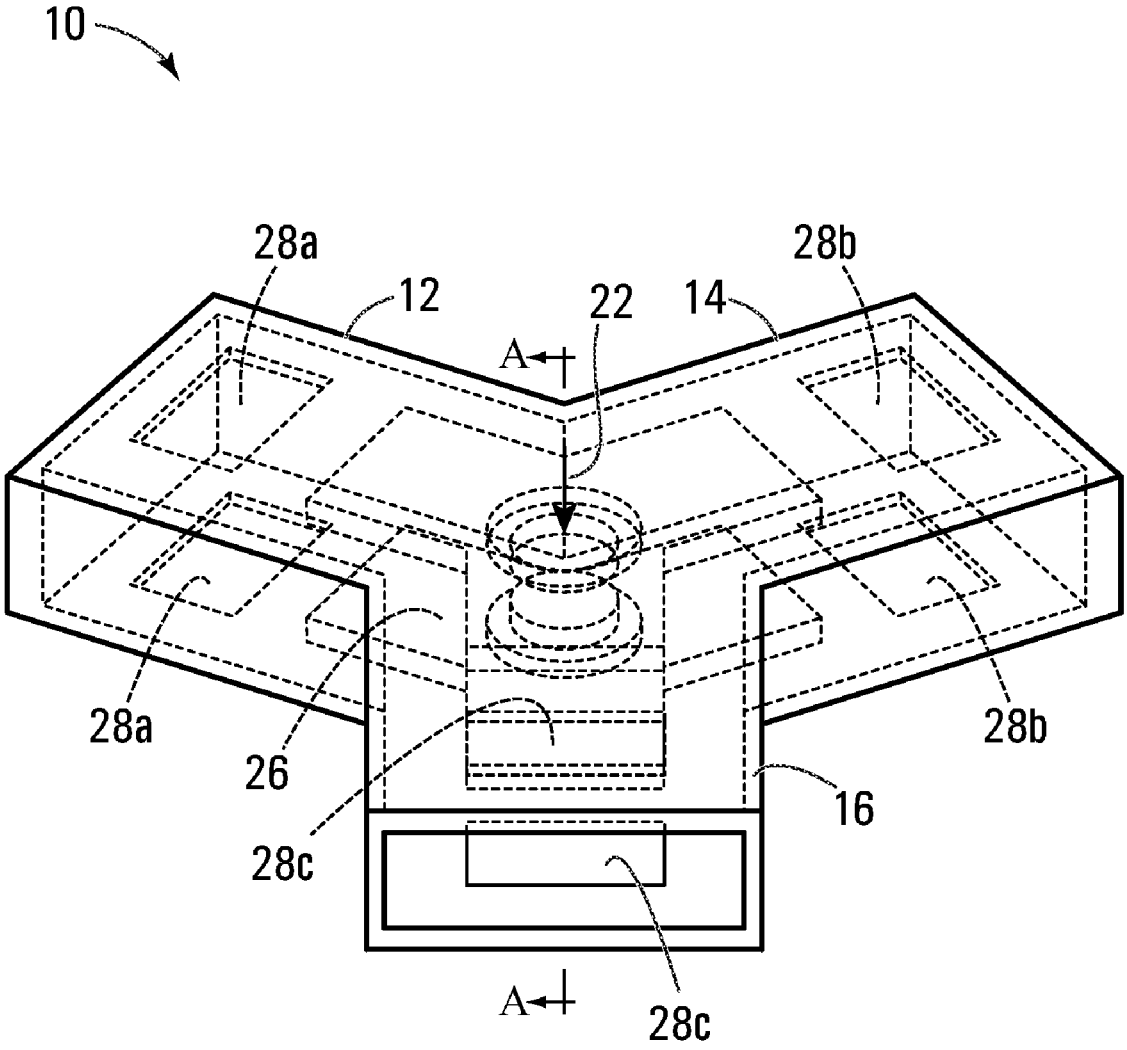
FIG. 1 shows a perspective view of a waveguide circulator in accordance with a non-limiting example of implementation of the present invention.

Other aspects and features of the present invention will become apparent to those ordinarily skilled in the art upon review of the following description of specific embodiments of the invention in conjunction with the accompanying figures.

DETAILED DESCRIPTION

Shown in FIGS. 1 through 5 is a waveguide circulator 10 in accordance with a non-limiting example of implementation of the present invention. As shown, the waveguide circulator 10 comprises three waveguide arms 12, 14 and 16 that meet at a common junction 18. In the embodiment shown, the three waveguide arms 12, 14 and 16 are evenly spaced at 120° angles in relation to each other. Although three evenly spaced waveguide arms 12, 14 and 16 are shown in the Figures, it is within the scope of the present invention for the waveguide circulator to include more or less than three waveguide arms, as well as waveguide arms that are not evenly spaced.

Positioned within the junction 18 of the waveguide circulator 10 are a pair of gyromagnetic members 20, which are typically made of a ferrite material. The gyromagnetic members 20 are positioned within the junction 18 in a spaced-apart, opposing relationship, such that they are centrally disposed, and arranged symmetrically, with respect to the three waveguide arms 12, 14 and 16. The gyromagnetic members 20 can be of a variety of shapes and/or sizes, depending on the desired characteristics of the waveguide circulator. For example, the gyromagnetic members can be of a triangular shape or a cylindrical disk shape, as shown in the Figures. For the remainder of the present description, the gyromagnetic members 20 will be referred to as ferrite elements 20.

During operation, the ferrite elements 20 are subjected to the influence of a magnetic field that is generated by one or more magnets or an electromagnet (not shown), which can be positioned above and below the ferrite elements 20. The magnetic field that is generated is a uni-directional magnetic field, represented by arrow 22 in FIG. 1, such that wave energy entering each waveguide arm 12, 14 and 16 will move in a counter-clockwise direction towards it's neighboring waveguide arm. For example, wave energy from waveguide arm 12 propagates to waveguide arm 16. Likewise, wave energy from waveguide arm 16 propagates to waveguide arm 14 and wave energy entering waveguide arm 14 propagates to waveguide arm 12. In this manner, wave energy is always propagated in a single direction. As such, the waveguide circulator 10 is a non-reciprocal transmitter of electromagnetic wave energy propagating in the waveguide arms. By changing the direction of the magnetic field, it is possible for the wave energy to propagate in the opposite, clockwise, direction. However, regardless of the direction in which the wave energy is propagated, it can only ever travel in one direction at a time.

Figure 2:
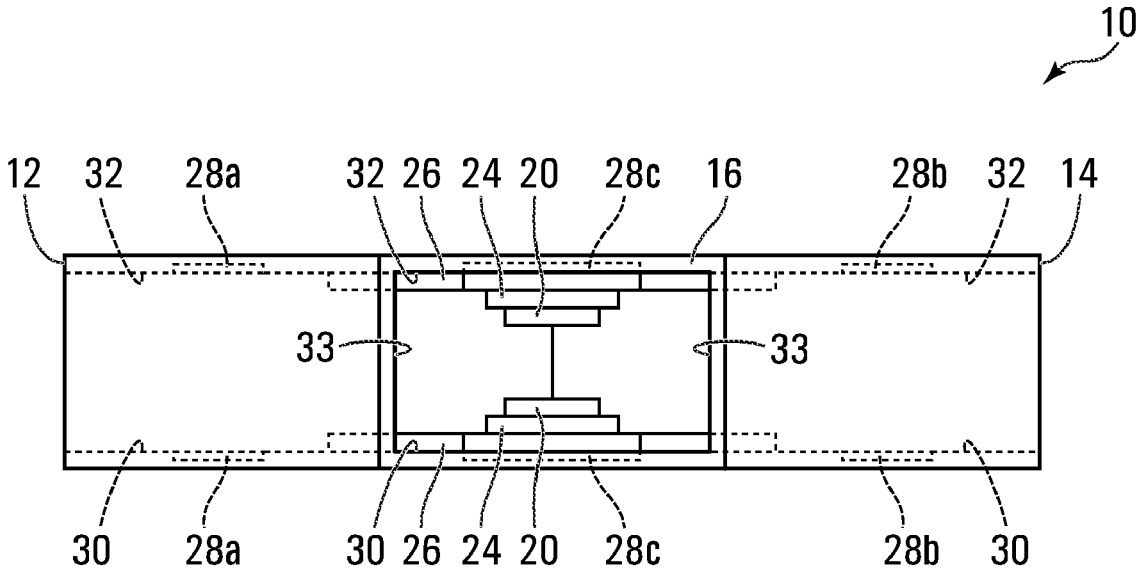
FIG. 2 shows a side plan view of the waveguide circulator of FIG. 1, exposing the interior of a waveguide arm.

Shown in FIG. 2 is a side view of the waveguide circulator 10 with a view into waveguide arm 16. The waveguide arms 12, 14 and 16 have a substantially rectangular cross section, defined by a base wall 30, an upper wall 32 and two side walls 33. The ratio of the sides of the rectangular waveguide arms 12, 14 and 16 (known as the aspect ratio) is generally in the order of 2:1, such that the waveguide arms can propagate wave energy in the transverse electric (TE10) mode. Although the waveguide arms shown are of a generally rectangular cross section, it should be appreciated that waveguide arms of other cross sections (such as oval, or circular) are also included within the scope of the present invention.

As mentioned above, the ferrite elements 20 depicted in the Figures are of a cylindrical disk shape. The ferrite element 20 can be solid or small pieces tiled to form a disk shape, triangular shape or hexagonal shape. In addition, the two ferrite elements 20 shown are identical in diameter and thickness. In the non-limiting embodiment shown, the diameter is approximately a half wavelength at a selected frequency in the operational band of the circulator. The space between the ferrite elements 20 can vary, which will affect what is referred to as the "filling factor". The separation between the ferrite elements 20 can be used to adjust the gain bandwidth, and the peak power handling of the design. The size of the ferrite elements 20 is dictated by the desired frequency of the circulator.

Each of the ferrite elements 20 is mounted to a mounting post 24, which in turn is mounted to a respective impedance transformer 26. The mounting posts 24 hold each of the respective ferrite elements 20 in place, and form an electrical wall by making contact with the ferrite elements 20. This arrangement provides a resonator with both a top and bottom electrical wall and a magnetic wall all around the formed effective resonator.

The ferrite elements 20 have an intrinsic impedance that is different from the impedance of the feeding waveguide arms. As such, the two impedance transformers 26 are included within the waveguide circulator 10 in order to reduce the impedance of the waveguide circulator 10 at the location of the ferrite elements 20. This acts to maximize the power transfer between the input and the output of the circulator as well as to minimize the internal reflection within the circulator. Therefore, the impedance transformers 26 are included in order to match the impedance of a gyrator (which is the combination of the ferrite elements 20 and the mounting posts 24) to the waveguide arms 12, 14 and 16. This smooth transition of the impedance is performed by reducing the effective height of the waveguide circulator 10 in the region of the junction 18. By reducing the height within the junction 18, the impedance of this section is reduced to a certain value between the impedance of the circulator arms 12, 14 and 16 and that of the gyrator.

As shown, the impedance transformers 26 are essentially formed from metal plates that reduce the height within the junction 18 of the waveguide circulator 10. Depending on the operating frequency band, the impedance transformers 26 will have a different length and height (which translates into a different wavelength). In accordance with a non-limiting example of implementation, the impedance transformers 26 are ¼λ transformers. In accordance with a non-limiting example of implementation, this is achieved by reducing the aspect ratio within the waveguide arms to 4:1. However, it should be appreciated that any dimension and shape could be used without affecting the end result significantly. It should, however, be appreciated that the dimension of the waveguide is related to frequency.

Figure 3:
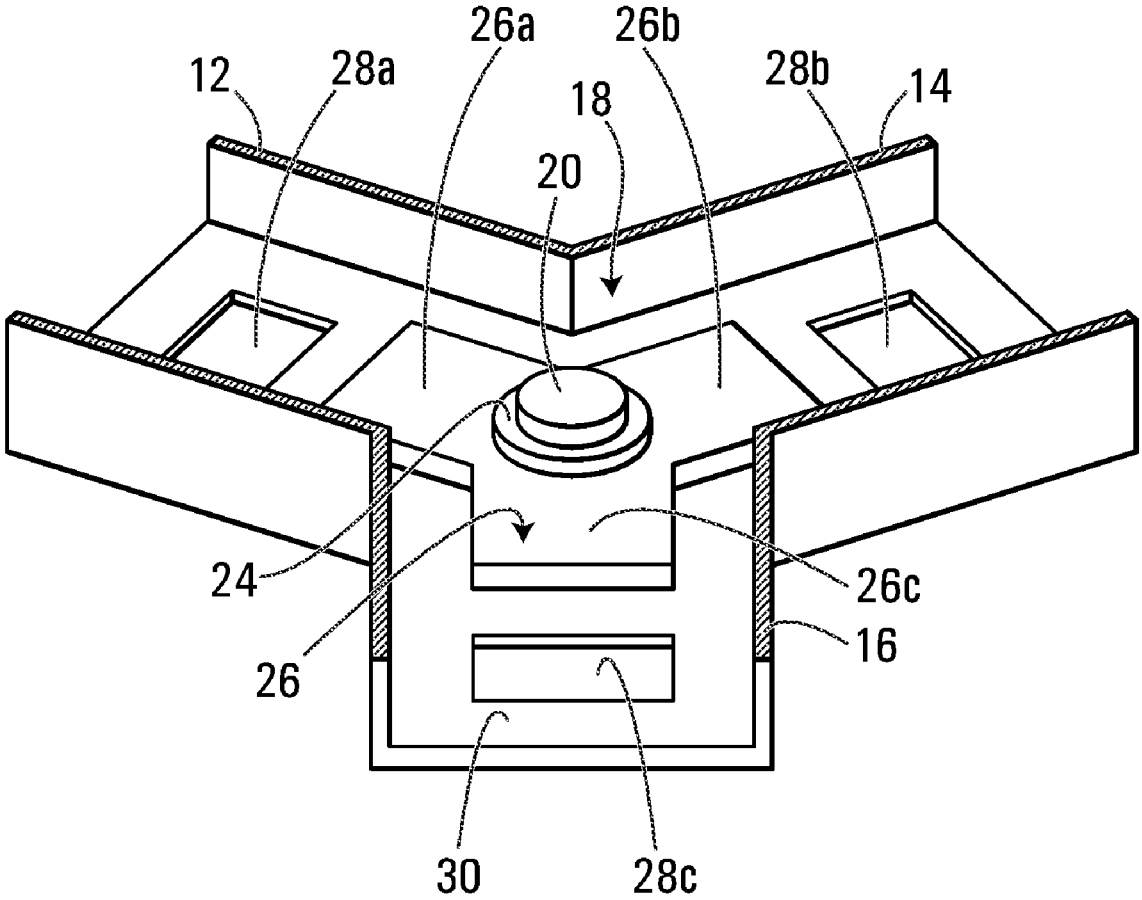
FIG. 3 shows a top perspective view of the waveguide circulator of FIG. 1 with a top portion cut away in order to expose an interior of the waveguide circulator.
Figure 4:
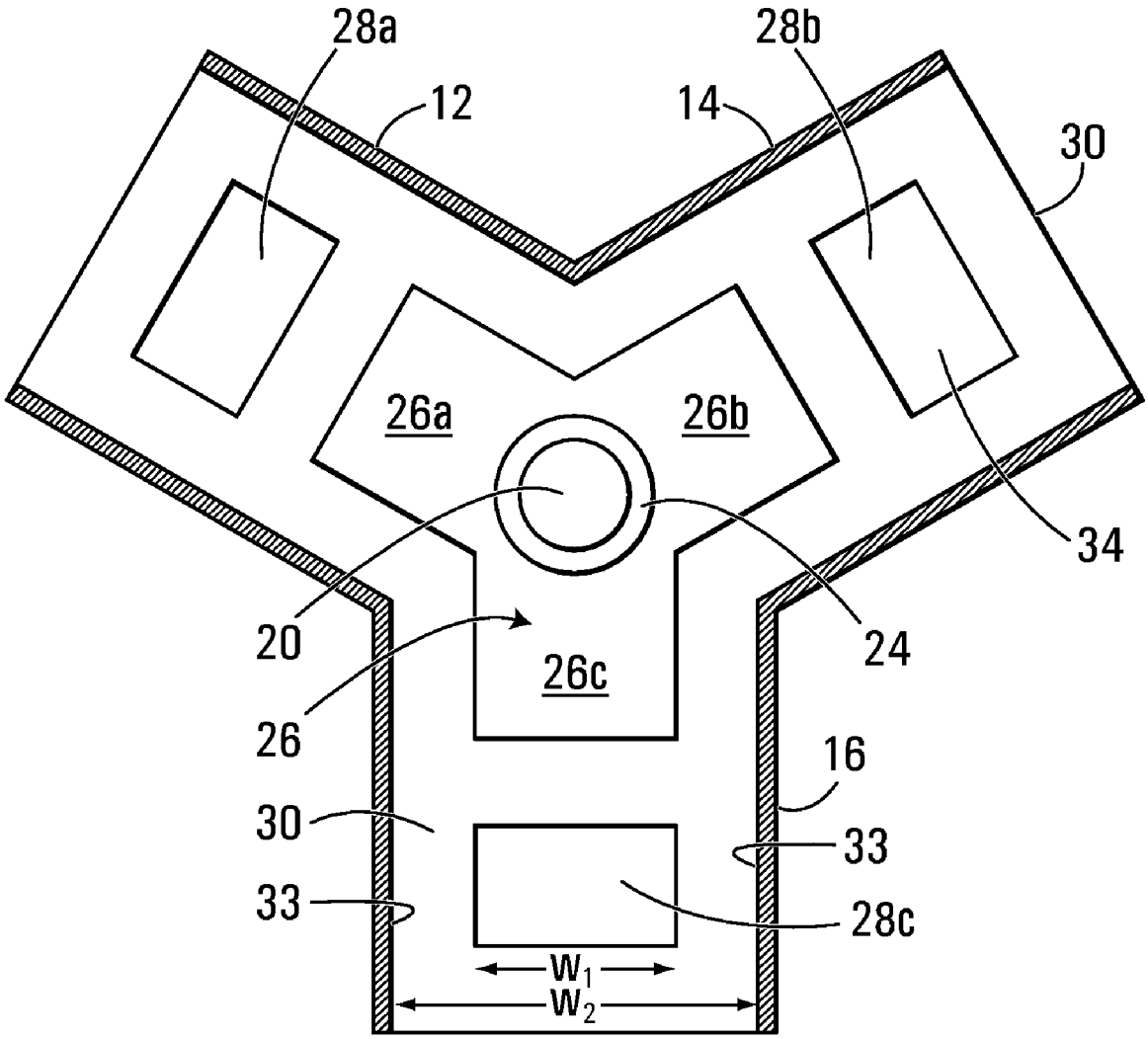
FIG. 4 shows a top plan view of the portion of the waveguide circulator shown in FIG. 3.

FIG. 3 shows a perspective view of the waveguide circulator 10 with the top portion removed, such that only the ferrite element 20, the mounting post 24 and the impedance transformer 26 positioned on the base wall 30 are shown. FIG. 4 shows a top plan view of the waveguide circulator 10 with the top portion removed. In accordance with the non-limiting embodiment shown, the impedance transformer 26 is in the shape of a single Y-shaped plate having three arms 26*a*, 26*b* and 26*c*. The impedance transformer 26 may be positioned entirely within the junction 18, or as shown in FIGS. 3 and 4, the three arms 26*a*, 26*b* and 26*c* of the impedance transformer 26 may extend into each waveguide arm 12, 14 and 16, respectively. As such, the single impedance transformer 26 acts as three transformers 26*a*, 26*b* and 26*c*, that are each respectively associated with one of the waveguide arms 12, 14 and 16. In an alternative embodiment, it is possible to have three separate impedance transformers 26*a*, 26*b* and 26*c* that are not attached together, with each one of the impedance transformers corresponding to a respective one of the waveguide arms 12, 14 and 16.

Referring back to FIG. 2, the impedance transformers 26 project respectively from the base wall 30 and the upper wall 32 of the waveguide arms 12, 14, 16 and the junction 18. In accordance with a non-limiting example of implementation, the impedance transformers 26 are integrally formed with the base wall 30 and upper wall 32 of the waveguide circulator 10. However, it should be appreciated that the impedance transformers 26 could be formed as separate plates that are secured to the base wall 30 and the upper wall 32, respectively, during the manufacturing process.

As mentioned above, the inclusion of the impedance transformers 26 within the junction 18 of the waveguide circulator 10 reduces the height separating the ferrite elements 20. This reduction in height, while working towards normalizing the impedance of the waveguide circulator 10, reduces the power handling capabilities and the bandwidth handling capabilities of the waveguide circulator 10.

In order to increase the power and bandwidth handling capabilities, the waveguide circulator 10 in accordance with the present invention includes a set of three transformers 28*a*, 28*b* and 28*c* that are recessed within the base wall 30 of the waveguide arms 12, 14 and 16, and a set of three transformers 28*a*, 28*b* and 28*c* that are recessed within the upper wall 32 of the waveguide arms 12, 14 and 16. These transformers 28*a*, 28*b* and 28*c* enable the waveguide circulator 10 to be able to handle increased power and bandwidth.

Figure 5:
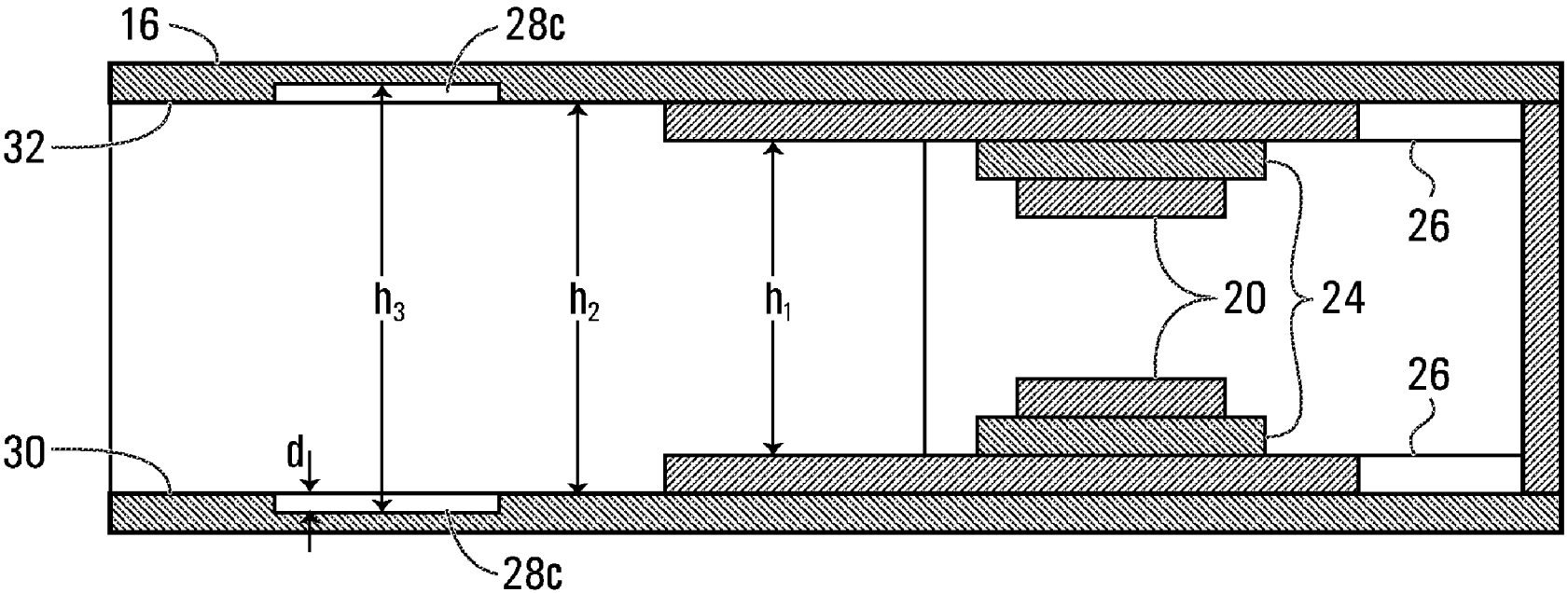
FIG. 5 shows a cross-sectional view of the waveguide circulator of FIG. 1, taken along lines A-A.

As shown with reference to FIG. 5, the three transformers 28*a*, 28*b* and 28*c* that are recessed within the base wall 30 and the three transformers 28*a*, 28*b* and 28*c* that are recessed within the upper wall 32, are positioned in a substantially opposing relationship. As such, the height within the waveguide arms 12, 14 and 16 in the region where the transformers 28*a*, 28*b* and 28*c* are positioned opposite each other, is greater than the height in the remaining portions of the waveguide arms 12, 14 and 16. More specifically, the waveguide circulator 10 of the present invention includes three different heights "h1" "h2" and "h3" within the three waveguide arms 12, 14, 16 and the junction 18. The height "h1" is the height between the two impedance transformers 26, the height "h2" is the height between the base wall 30 and the upper wall 32, and the height "h3" is the height between the two recessed transformers 28*c*. As shown, the height "h1" between the surfaces of the two impedance transformers 26 is less than the height "h2" between the base wall 30 and the upper wall 32, which is less than the height "h3" between the surfaces of the two opposing recessed transformers 28*c*.

Referring back to FIG. 4, the transformers 28*a*, 28*b* and 28*c* each have a width "w1" that is equivalent to the width of each of the impedance transformer arms 26*a*, 26*b* and 26*c*. In accordance with the present invention, the transformers 28*a*, 28*b* and 28*c* are centered between the two side walls 33 of each waveguide arm 12, 14 and 16, and have a width "w1" of approximately 30-70% of the width "w2" of the base wall 30 and upper wall 32. As such, the transformers 28*a*, 28*b* and 28*c* are not as wide as the base wall 30 and the upper wall 32, thereby leaving a small gap between each of the side walls 33 and the transformers 28*a*, 28*b* and 28*c*. This gap provides a lower cut off frequency for the waveguide circulator, and the optimal width for this gap can be determined empirically for each waveguide circulator.

The transformers 28*a*, 28*b* and 28*c* are positioned within the waveguide arms 12, 14 and 16, respectively, at a further radial distance from the ferrite elements 20 than the impedance transformers 26. In general, the transformers 28*a*, 28*b* and 28*c* are positioned at the characteristic plane of the gyrator, which may be determined by locating the position of the short circuit plane at one port with another one terminated in a short circuit piston.

Each of the transformers 28*a*, 28*b* and 28*c* is recessed within the base wall 30 and the upper wall 32 of the waveguide arms 12, 14 and 16. In accordance with a non-limiting example of implementation, the transformers 28*a*, 28*b* and 28*c* are recessed to a depth "d" in such a way to lower the impedance of this section between 5-15% from the normalized impedance of the circulator waveguide arm. In the case where the impedance transformers 26 are ¼λ transformers, it has been found that in order to satisfactorily improve the waveguide circulator's 10 power handling capabilities and bandwidth handling capabilities, the transformers 28*a*, 28*b* and 28*c* should be ½λ transformers. It should be appreciated that the transformers 28*a*, 28*b* and 28*c* could also be 1/12λ, ¼λ and ½λ, without departing from the spirit of the invention. The selection of recessed transformer wavelength can depend on a variety of factors, such as the size and wavelength of the impedance transformers 26 that are included within the waveguide circulator 10.

By adding the recessed transformers 28*a*, 28*b* and 28*c* to the waveguide circulator 10, the passband return loss of the waveguide circulator 10 remains low, which results in a low reflected power. The reflected power must be kept below an acceptable level (so as not to damage the input source), and therefore, by maintaining the reflected power low, more power can be input into the waveguide circulator 10, thus improving the waveguide circulator's power handling abilities. In addition to maintaining the return loss at a relatively low level, the recessed transformers 28*a*, 28*b* and 28*c* enable an increase in the bandwidth that can be handled by the waveguide circulator 10. This will be described in more detail below with respect to the graph shown in FIG. 7.

Figure 7:
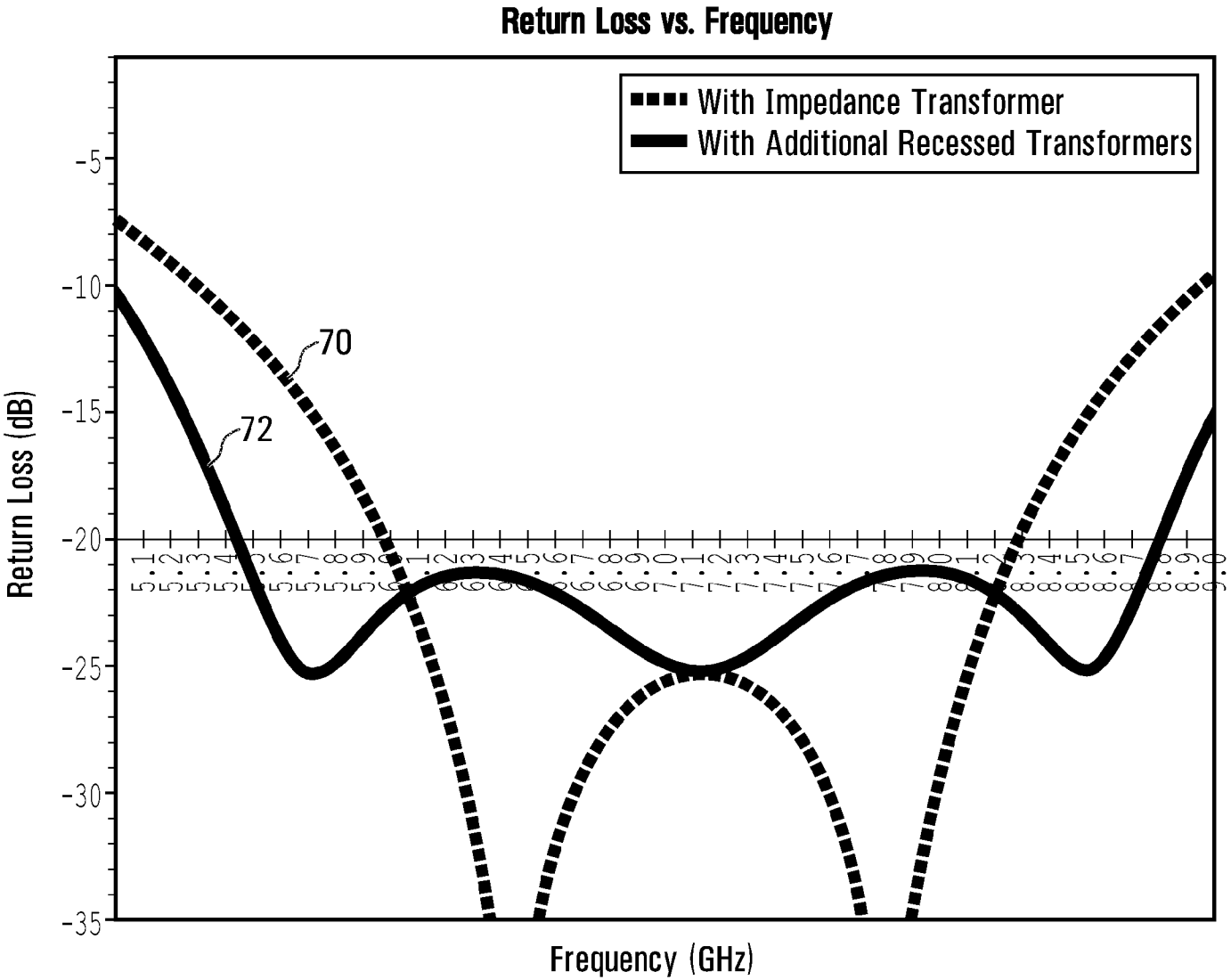
FIG. 7 shows a graph of Return Loss vs. Frequency for two waveguide circulators.

As mentioned above, in accordance with a non-limiting example of implementation, the impedance transformers 26 are ¼λ transformers and the recessed transformers 28*a*, 28*b* and 28*c* are ½λ transformers. Shown in FIG. 7 is a graph that plots the "Return Loss (dB) vs Frequency" for a waveguide circulator that has only impedance transformers 26 (the dashed line 70), and a waveguide circulator 10, in accordance with the present invention, that includes both impedance transformers 26 and recessed transformers 28*a*, 28*b* and 28*c* (the solid line 72). As shown, the bandwidth handling capabilities of the waveguide circulator 10 of the present invention are greater than those of the waveguide circulator that does not include the recessed transformers. More specifically, in accordance with the non-limiting example shown, the waveguide circulator that does not include the recessed transformers displays a bandwidth range (at a return loss of −23) of approximately 6.1-8.2 GHz, which translates into a percentage bandwidth value of approximately 26-30%. However, the waveguide circulator 10 in accordance with the present invention, displays a bandwidth range of approximately 5.5-8.8 GHz, which translates into a percentage bandwidth of approximately 42-48%. The percentage bandwidth value is calculated via the following formula:

$$\%\ \text{bandwidth} = \left.\frac{\text{frequency(high)} - \text{frequency(low)}}{\text{(frequency(high)} + \text{frequency(low)}}\right\} \Big/ 2$$

An advantage of having the ½λ transformers 28*a*, 28*b* and 28*c* be recessed within the base wall 30 and within the upper wall 32 is that the recessed transformers do not create additional impedance within the waveguide circulator 10. In the case where a waveguide circulator includes ½λ transformers that project from the base wall 30 and the upper wall 32 of the waveguide arms (instead of being recessed within these walls), it is impossible for the ¼λ transformers to properly normalize the impedance created. As such, in the case where the ½λ transformers project within the waveguide arms 12, 14 and 16, the ¼λ transformers are considered to be non-optimum transformers. Whereas, by recessing the ½λ transformers within the base wall 30 and the upper wall 32, this deficiency is eliminated, such that the ¼λ transformers can adequately match the impedance of the gyrator (which is a combination of the ferrite elements 20 and the mounting posts 24) and the ½λ transformers.

In the case where only ferrite elements 20 are included within a waveguide circulator, the ferrite elements act as a resonator, such that the waveguide circulator displays a degree-1 response (1-pole). In the case where a waveguide circulator includes both the ferrite elements 20 and impedance transformers 26, the waveguide circulator displays a degree-2 response (2-pole). The waveguide circulator 10 in accordance with the present invention includes both impedance transformers 26 and recessed transformers 28*a*, 28*b* and 28*c*, thus displaying a degree-3 response (3-pole). This can be seen in the graph of FIG. 7, wherein the waveguide circulator with only the impedance transformers (line 70) that it is a 2-pole waveguide circulator has two peaks, and the waveguide circulator 10 with the impedance transformers 26 and the recessed transformers 28*a*, 28*b* and 28*c* that is a 3-pole waveguide circulator 10 has three peaks.

Waveguide circulators 10 in accordance with the present invention can be manufactured via molding, casting, or machining, among other possible manufacturing techniques. Generally speaking, the waveguide circulators 10 are made in two separate portions; namely a bottom portion and an upper portion, that are then coupled together in order to form the complete waveguide circulator 10. The bottom portion and the top portion can be coupled together via welding, bolts, rivets, or any other type of mechanical fastener known in the art.

In accordance with a non-limiting example of implementation, the waveguide circulators 10 of the present invention are made of aluminum. However, it should be appreciated that the waveguide circulator 10 could be made of any suitable material, such as copper or brass, among other possibilities.

In the case where the portions of the waveguide circulator 10 are manufactured via molding or casting, then the recessed transformers 28*a*, 28*b* and 28*c* can be created at the same time as the impedance transformers. However, in the case where the waveguide circulator 10 is made via machining, the recessed transformers 28*a*, 28*b* and 28*c* may be machined into the base wall 30 and the upper wall 32 of the waveguide arms 12, 14 and 16, after the impedance transformers have been formed. Typically, the ferrite elements 20 are the final components to be included within the two portions of the waveguide circulator 10. In some embodiments, a piece of dielectric can be inserted between the ferrite elements 20 (thus filling the gap between the ferrite elements 20) to increase the peak power handling of the waveguide circulator 10.

An advantage of recessed transformers 26*a*, 26*b* and 26*c* is that they can be added to existing waveguide circulator designs in order to improve the power handling capabilities and bandwidth handling capabilities of existing waveguide circulators 10. More specifically, in order to add a recessed transformer to existing waveguide to circulators, the waveguide circulator is taken apart, such that the base wall 30 and the upper wall 32 of the waveguides are exposed. The recessed transformers 28*a*, 28*b* and 28*c* can then be machined into the surfaces of these two walls.

Figure 6:
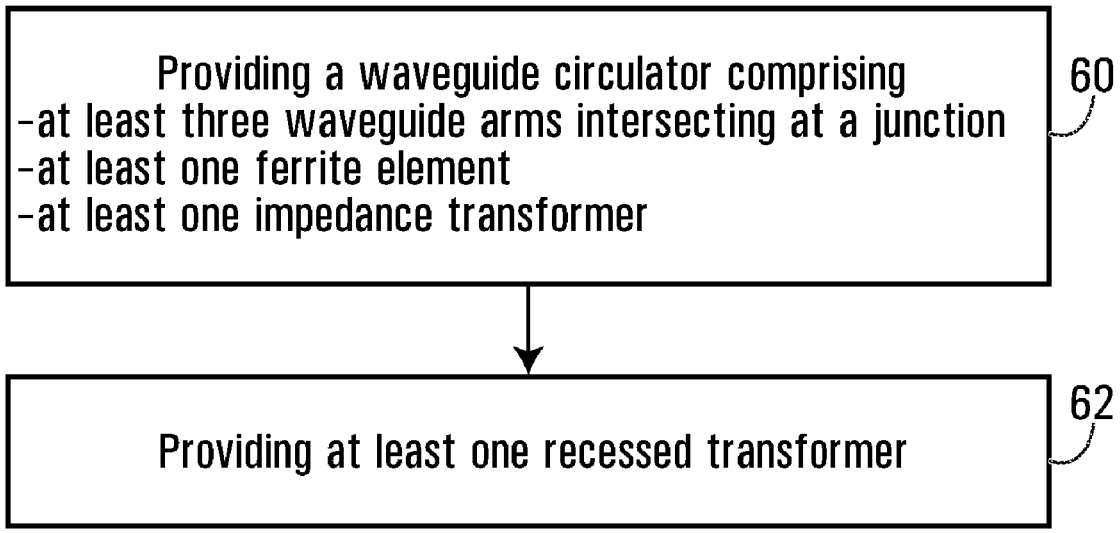
FIG. 6 shows a non-limiting flow diagram of a process for manufacturing a waveguide circulator in accordance with the present invention.

Shown in FIG. 6 is a non-limiting flow diagram of a method of retro-fitting a waveguide circulator 10 with recessed transformers 28*a*, 28*b* and 28*c*. Firstly, at step 60, the method involves providing a waveguide circulator 10 that comprises at least three waveguide arms 12, 14 and 16, at least one ferrite element 20 (which is preferably in the shape of a cylindrical disk) and at least one impedance transformer 26. Although the ferrite elements are included in the flow chart of FIG. 6, it is possible that the ferrite elements are added following step 62 of the method. At step 62, once the waveguide circulator has been taken apart so as to expose the base wall 30 and the upper wall 32, the method involves providing at least one recessed transformer within one of the waveguide arms 12, 14 and 16.

In the case where the recessed transformers 28*a*, 28*b* and 28*c* are retro-fit into existing waveguide circulators 10, they are generally machined into the base wall 30 and upper walls 32 of the waveguide arms 12, 14 and 16, once the waveguide transformer has been taken apart.

In the above description, only three ports (waveguide arms 12, 14 and 16) have been shown and discussed. It should however be appreciated that the recessed transformers 28*a-c* shown and described herein could be equally applied to T-junction circulators, four-port circulators, or circulators having any number of ports.

Although the present invention has been described in considerable detail with reference to certain preferred embodiments thereof, variations and refinements are possible without departing from the spirit of the invention. Therefore, the scope of the invention should be limited only by the appended claims and their equivalents.

What is claimed is:

1. A circulator, comprising:

a) at least three waveguide arms intersecting at a junction, at least a portion of said at least three waveguide arms and said junction defining a first wall and a second wall that are positioned in an opposing relationship;

b) at least one ferrite element positioned within said junction;

c) an impedance transformer positioned in proximity to said at least one ferrite element, said at least one impedance transformer projecting from said first wall; and d) a recessed transformer positioned in proximity to said impedance transformer, said recessed transformer being recessed within said first wall.

2. A circulator as defined in claim 1, wherein said impedance transformer is integrally formed with said first wall.

3. A circulator as defined in claim 1, wherein each of said at least three waveguide arms comprises a rectangular tube, wherein opposing inner walls of said rectangular tubes create at least a portion of said first wall and said second wall.

4. A circulator as defined in claim 3, wherein said impedance transformer is a first impedance transformer in a set of two impedance transformers, said two impedance transformers being positioned respectively on said first wall and said second wall in an opposing manner.

5. A circulator as defined in claim 4, wherein each of said two impedance transformers includes at least three transformer arms that extend into respective ones of said at least three waveguide arms.

6. A circulator as defined in claim 4, wherein said recessed transformer is a first recessed transformer in a set of three recessed transformers, wherein each of said three recessed transformers is recessed within a first wall of a respective one of said at least three waveguide arms.

7. A circulator as defined in claim 6, wherein said first wall and said second wall are separated by a certain distance, wherein a distance between said two impedance transformer is less than said certain distance, and wherein a distance between two opposing ones of said recessed transformers is greater than said certain distance.

8. A circulator as defined in claim 6, wherein said set of three recessed transformers is a first set of three recessed transformers, said circulator further comprising a second set of three recessed transformers, wherein each of said recessed transformers in said second set of three recessed transformers is recessed within a second wall of a respective one of said at least three waveguide arms.

9. A waveguide circulator comprising three waveguide arms each comprising a first wall and a second wall, said three waveguide arms intersecting at a junction that includes at least one ferrite element therein, each of said three waveguide arms comprising:

i) an impedance transformer projecting from said first wall; and ii) a recessed transformer that is recessed within said first wall.

10. A waveguide circulator as defined in claim 9, wherein said first wall and said second wall are opposing inner walls of a rectangular waveguide arm.

11. A waveguide circulator as defined in claim 10, wherein each of said three waveguide arms further comprises:

a) an impedance transformer projecting from said second wall; and b) a recessed transformer that is recessed within said second wall.

12. A waveguide circulator as defined in claim 11, wherein said impedance transformer projecting from said first wall and said impedance transformer projecting from said second wall each include three transformer arms that extend respectively from said junction into said at least three waveguide arms.

13. A waveguide circulator as defined in claim 11, wherein said first wall and said second wall are separated by a certain distance, wherein a distance between said impedance transformers is less than said certain distance, and wherein a distance between two opposing ones of said recessed transformers is greater than said certain distance.

14. A method, comprising:

a) providing a waveguide circulator comprising:

i) at least three waveguide arms intersecting at a junction, the at least three waveguide arms and the junction defining a first wall and a second wall that are positioned in an opposing relationship;

ii) at least one ferrite element positioned within the junction; and iii) at least one impedance transformer within the waveguide circulator in proximity to the at least one ferrite element, said impedance transformer projecting into the junction;

b) providing at least one recessed transformer into the first wall of the waveguide circulator.

15. A method as defined in claim 14, wherein providing the at least one recessed transformer into the first wall of the circulator comprises machining the at least one recessed transformer into the first wall of the circulator.

16. A method as defined in claim 14, wherein the circulator comprises a first portion and a second portion that are coupled together, said method further comprising separating the first portion of the circulator from the second portion prior to machining the at least one recessed transformer into the first wall.

* * * * *